US006178802B1

(12) United States Patent
Reynolds

(10) Patent No.: US 6,178,802 B1
(45) Date of Patent: Jan. 30, 2001

(54) SLOTTED CRIMPING DIE FOR USE IN A CRIMPING MACHINE

(75) Inventor: Andrew P. Reynolds, Bedford (GB)

(73) Assignee: The Gates Corporation, Denver, CO (US)

( * ) Notice: Under 35 U.S.C. 154(b), the term of this patent shall be extended for 0 days.

(21) Appl. No.: 09/291,240

(22) Filed: Apr. 13, 1999

(51) Int. Cl.[7] ..... B21D 39/04
(52) U.S. Cl. ..... 72/402; 29/237
(58) Field of Search ..... 72/402, 409.19; 29/237

(56) References Cited

U.S. PATENT DOCUMENTS

| | | | | |
|---|---|---|---|---|
| 3,568,494 | * | 3/1971 | Geisman | 72/402 |
| 3,805,580 | | 4/1974 | Leiker | 72/402 |
| 4,244,091 | | 1/1981 | Kimble et al. | 29/237 |
| 4,577,485 | | 3/1986 | Moreiras | 72/402 |
| 5,447,048 | * | 9/1995 | Tanaka | 72/402 |
| 5,644,945 | | 7/1997 | Baldwin et al. | 72/402 |
| 5,797,629 | | 8/1998 | Beagle | 285/256 |
| 5,799,531 | * | 9/1998 | Orcutt | 72/402 |
| 5,894,753 | * | 4/1999 | Sachot | 72/402 |

FOREIGN PATENT DOCUMENTS

| | | | | |
|---|---|---|---|---|
| 1581658 | * | 9/1969 | (FR) | 72/402 |

* cited by examiner

*Primary Examiner*—Daniel C. Crane
(74) *Attorney, Agent, or Firm*—C. H. Castleman, Esq.; S. G. Austin, Esq.; J. A. Thurnau, Esq.

(57) ABSTRACT

A die finger and a crimping die comprising a plurality of circumferentially spaced die fingers used in a crimping apparatus, wherein the die finger has an inner forming surface and an oppositely facing camming surface, and wherein at least one die finger having the inner forming surface includes at least one slot formed therein oriented along the longitudinal axis. Also included is a crimping apparatus utilizing the inventive die fingers, a method of crimping a ferrule with the inventive die fingers and a ferrule crimped by the inventive method.

19 Claims, 4 Drawing Sheets

SLOTTED CRIMPING DIE FOR USE IN A CRIMPING MACHINE

BACKGROUND OF THE INVENTION

The present invention relates generally to die fingers for use in a crimping apparatus. More particularly, the invention relates to a crimping die for use in a crimping apparatus comprising a plurality of circumferentially spaced adjacent die fingers, each of said die fingers having an inner forming surface and an oppositely facing camming surface for engaging a cam of the crimping apparatus. Specifically, the invention relates to a crimping die wherein said die fingers having inner forming surfaces including a slot formed therein oriented along the longitudinal axis, wherein the slot has a length substantially equal to the length of the inner forming surface.

Crimping machines for crimping fittings onto the end of hoses, such as stem/ferrule single or two-piece couplings for hydraulic hose, are well known. It is well known in the production of hose assemblies to permanently secure a metal hose coupling onto the end of a hose by crimping a ferrule around the hose to cause the hose to be tightly held between the ferrule of the coupling and a fitting positioned inside the hose. In the crimping process, the crimping die engages the entire ferrule of the coupling. The crimping die reduces the ferrule in diameter to secure the coupling to the hose end.

The crimping die is typically constructed from a plurality of circumferentially spaced die fingers. The crimping die typically has an inner surface that is substantially cylindrical and an oppositely facing cam surface sized for engaging a cam of the crimping apparatus. The die fingers are spaced apart from each other in an expanded mode so as to permit the hose coupling which is to be crimped to be placed in the center of the crimping die. The die fingers are then driven, typically by a hydraulic ram of the crimping machine, in the direction of the ferrule to be crimped. This causes simultaneous radial inward movement of the die fingers and a contraction of the crimping die. With the ferrule of the hose coupling positioned within the center of the crimping die, radial inward deformation is effected to secure the coupling onto the hose end.

Crimping dies are typically constructed with eight die fingers. The radial deformation caused by the eight finger crimping die results in a matching eight segment deformation in the collar/ferrule of the coupling. After crimping, the ferrule of the coupling has eight grooves and eight ribs. The eight ribs are created from the material flowing in between the eight die fingers during crimping. After crimping with an eight finger die, the inside diameter (ID) of the crimped ferrule resembles an octagon. The apexes of the octagonal shape form potential leak paths in the hose coupling.

A prior art hose coupling, U.S. Pat. No. 5,267,758 to Shah, et al., solves the problem of potential leak paths in the apexes of the octagonal ID of the ferrule. U.S. Pat. No. 5,267,758 discloses a ferrule containing a C-shaped insert. When a ferrule with a C-shaped insert is crimped onto a hose, the C-insert bends to a substantially round shape in contrast to a polygonal shape. The C-insert does solve the potential leak path problem but is not used on all ferrule product lines, due to the added expense of the C-insert. Hose ferrules are still used that do not utilize the C-insert and thus still have the problem of potential leak paths in the apexes of the octagonal ID of the ferrule.

Although the C-insert of U.S. Pat. No. 5,267,758 solves the problem of potential leak paths as described above, other problems do exist after crimping the ferrule containing the C-shaped insert. These other problems also exist with conventional ferrules that do not contain the C-shaped insert. When crimping a ferrule with a crimping die constructed from eight die fingers, eight ribs are created from the excess material flowing in between the eight die fingers during crimping. Due to the material flow there is a tendency for these ribs to be very uneven and have sharp, unsafe edges.

In many applications, the same size ferrule is crimped onto a hose with the same size inside diameter (ID) but having a large range of outside diameters (ODs). For example, the same size ferrule may be crimped onto ⅜ in. ID hose with hose ODs ranging from 0.62 to 0.80 in. The recommended crimp OD of a ferrule crimped onto a ⅜ in. ID, 0.74 in. OD hose is 0.89 in., whereas the recommended crimp OD of the same size ferrule crimped onto a ⅜ in. ID, 0.625 in. OD hose is 0.81 in. The rib problems mentioned above with uneven or sharp edges are more prominent in the latter of the two examples. This is because when crimping the standard ferrule to a smaller crimp OD, more metal must flow between the die fingers than when crimping to a larger crimp OD. When crimping the standard ferrule to a smaller crimp OD, the eight finger crimp may tend to be uneven or bulge due to insufficient pressure about the ferrule during the crimping process. As a result, the extra metal flow between the die fingers may form uneven and sharp ribs on the crimped ferrule.

The need remains, particularly in the area of crimping machines for radially crimping the ferrule of a hose coupling onto the end of a hose, for a method of crimping that solves the problems of sharp, uneven ribs in a crimped ferrule and of potential leak paths in a ferrule not having a C-insert.

SUMMARY OF THE INVENTION

Accordingly, the present invention has as an object the provision of a die finger used in a crimping die for crimping a ferrule, that solves the problem of sharp, uneven ribs in the crimped ferrule.

Another object of the present invention is the provision of a crimping die, formed of a plurality of die fingers, used in a crimping apparatus for crimping a ferrule, which provides improved roundness over the prior art crimping dies.

Another object of the present invention is the provision of a crimping apparatus used for crimping a ferrule, that solves the problem of sharp, uneven ribs in the crimped ferrule.

Another object of the present invention is the provision of a method of crimping which provides a more rounded, even crimp than prior art crimping methods.

Another object of the present invention is the provision of a crimped ferrule that has even, level ribs and is more rounded than prior art crimped ferrules.

To achieve the forgoing and other objects and in accordance with a purpose of the present invention, as embodied and broadly described herein, a die finger, a crimping die, an apparatus for crimping, a crimping method and a ferrule crimped therefrom is provided.

The invention is drawn to a die finger and a crimping die comprising a plurality of circumferentially spaced die fingers used in a crimping apparatus, wherein the die finger has an inner forming surface and an oppositely facing camming surface, and wherein at least one die finger having the inner forming surface includes a slot formed therein oriented along the longitudinal axis. The invention is also drawn to a crimping apparatus utilizing the inventive die fingers, a method of crimping a ferrule with the inventive die fingers and a ferrule crimped by the inventive method.

BRIEF DESCRIPTION OF THE DRAWINGS

The accompanying drawings, which are incorporated in and form a part of the specification and in which like numerals designate like parts, illustrate preferred embodiments of the present invention and together with the description, serve to explain the principles of the invention. In the drawings.

DETAILED DESCRIPTION OF THE PREFERRED EMBODIMENTS

Figure 1:
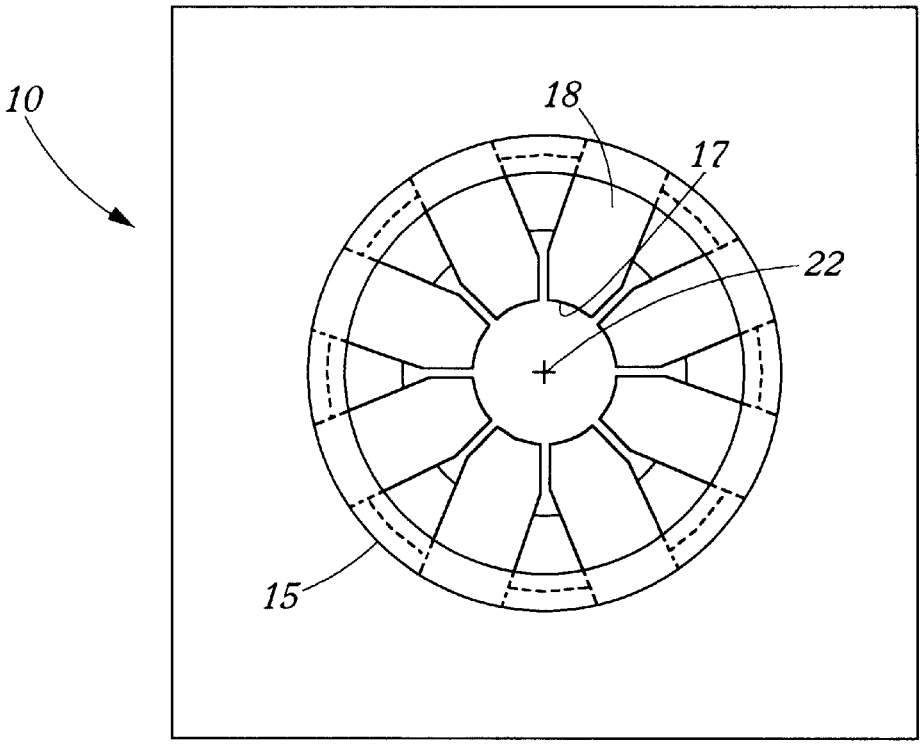
PRIOR ART Figure 1
FIG. 1 is a top plan view of a prior art crimping die.

Referring to FIG. 1, a prior art crimping apparatus is shown. FIG. 1 shows a top plan view of a prior art crimping apparatus, generally indicated at 10. FIG. 1 shows a crimping die 15, which comprises a plurality of circumferentially spaced prior art die fingers 8, with an inner forming surface 17, arranged radially about a longitudinal axis 22. A ferrule crimped in the prior art crimping apparatus 10 of FIG. 1 may form uneven and sharp ribs on the crimped ferrule, the disadvantages of which are overcome by the present invention.

Figure 2:
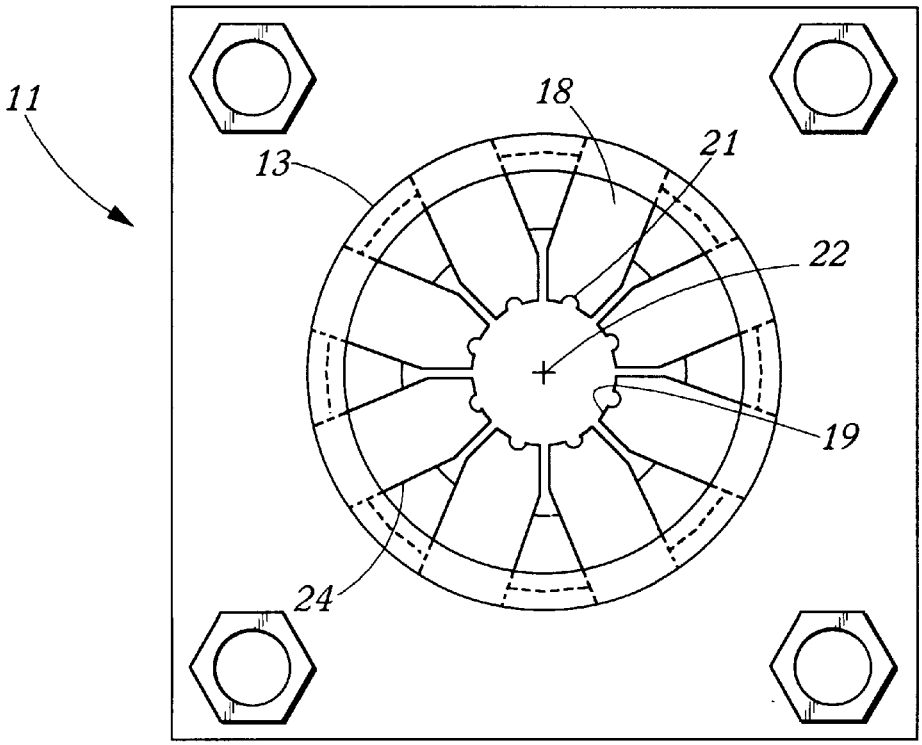
FIG. 2 is a top plan view of the crimping apparatus embodying the invention with no ferrule in place.
Figure 3:
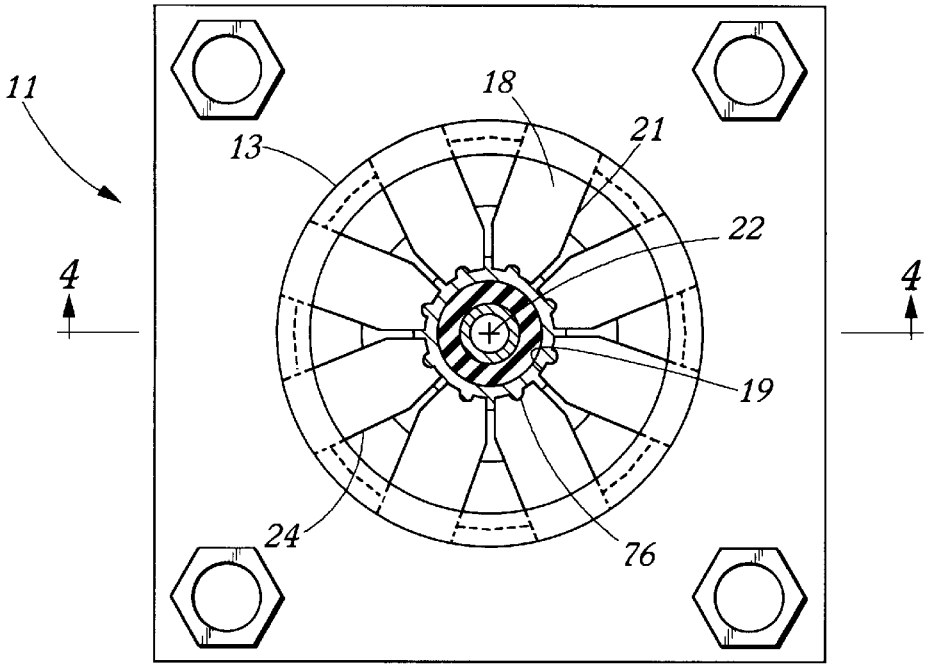
FIG. 3 is an enlarged top plan view of the crimping apparatus embodying the invention, showing a ferrule being crimped.

Referring to FIGS. 2 and 3, there is shown in accordance with the present invention a crimping die 13 in a crimping apparatus, generally indicated at 11. The crimping die 13 is comprised of a plurality of circumferentially spaced die fingers 18, with an inner forming surface 19, arranged radially about a longitudinal axis 22. The inner forming surface 19 includes a slot 21 formed therein, oriented along the longitudinal axis 22. As shown in FIGS. 2 and 3, the circumferentially spaced die fingers 18 are equally spaced.

FIG. 2 shows a crimping die in accordance with the present invention prior to crimping a ferrule about a hose. FIG. 3 shows the same crimping die during the crimping process. In a prior art crimping apparatus 10, as shown in FIG. 1, there are eight spaces in between the eight die fingers 8 for the metal of the ferrule to flow during the crimping process. In the crimping apparatus 11 of the present invention, as seen in FIGS. 2 and 3, there are eight spaces in between the eight die fingers 18 as well as eight slots 21 in the inner forming surface 19 of the die fingers 18 for the metal of the ferrule to flow during the crimping process. FIG. 3 shows the metal flowing into these sixteen areas during the crimping process. Although FIGS. 2 and 3 show a crimping die including die fingers having an inner forming surface including a slot which is substantially cylindrical, the present invention is not limited to a substantially cylindrical slot; the present invention may be used in a crimping die with any number of slot configurations.

Figure 4:
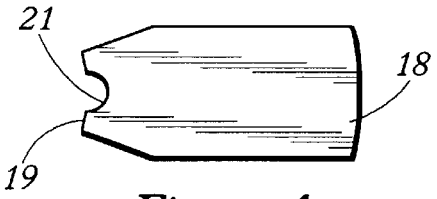
FIG. 4 is a top view of one die finger embodying the invention.
Figure 5:
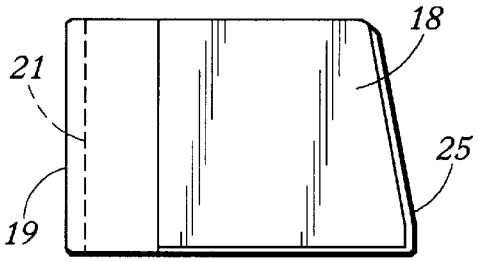
FIG. 5 is a side view of one die finger embodying the invention.
Figure 6:
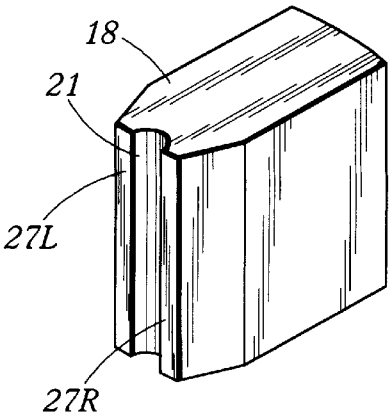
FIG. 6 is a perspective view of the die finger of FIGS. 4 and 5.

FIGS. 4–6 show a more detailed view of the die finger 18 of the present invention. As seen in the preferred embodiment of FIGS. 4–6, die finger 18 has an inner forming surface 19 including a slot 21 formed therein oriented along the longitudinal axis 22, as shown in FIGS. 2 and 3. As seen in FIG. 6, slot 21 divides the die finger 18 into two substantially equal portions 27L and 27R, each of which have a surface area. In a preferred embodiment, die finger 18 has a slot 21 with a width from about 5% to about 50% of the inner forming surface 19.

The slot 21 must also have a depth of sufficient size to accommodate displaced metal from a crimped ferrule. The depth of the slot will vary depending upon the size of the ferrule being crimped. A final crimp outside diameter (OD) is measured with calipers placed in between the ribs of the crimped ferrule. In a most preferred embodiment, when crimping a ferrule to a final crimp diameter of 16.79 mm, the radius of the slot 21 located in the die finger is 1 mm. In another most preferred embodiment, when crimping a ferrule to a final crimp diameter of 19.89 mm, the radius of the slot 21 located in the die finger is 1.25 mm. Other slot configurations which meet the requirements of the specific application are also envisioned.

FIG. 5 shows a side view of one embodiment of the inventive die finger 18. The depth of slot 21 can be seen in FIG. 5 in phantom, located on the inner forming surface 19 of the die finger 18. Also seen in FIG. 5. is the oppositely facing camming surface 25, which is sized for engaging a cam of a crimping apparatus.

The slot of the inventive die finger 18 may be formed by either milling or grounding a slot as a final machining operation before the die fingers are hardened in the machining process. It is envisioned that any other method of forming a slot 21 in the inner forming surface 19 of the die finger 18 may be used.

Figure 7:
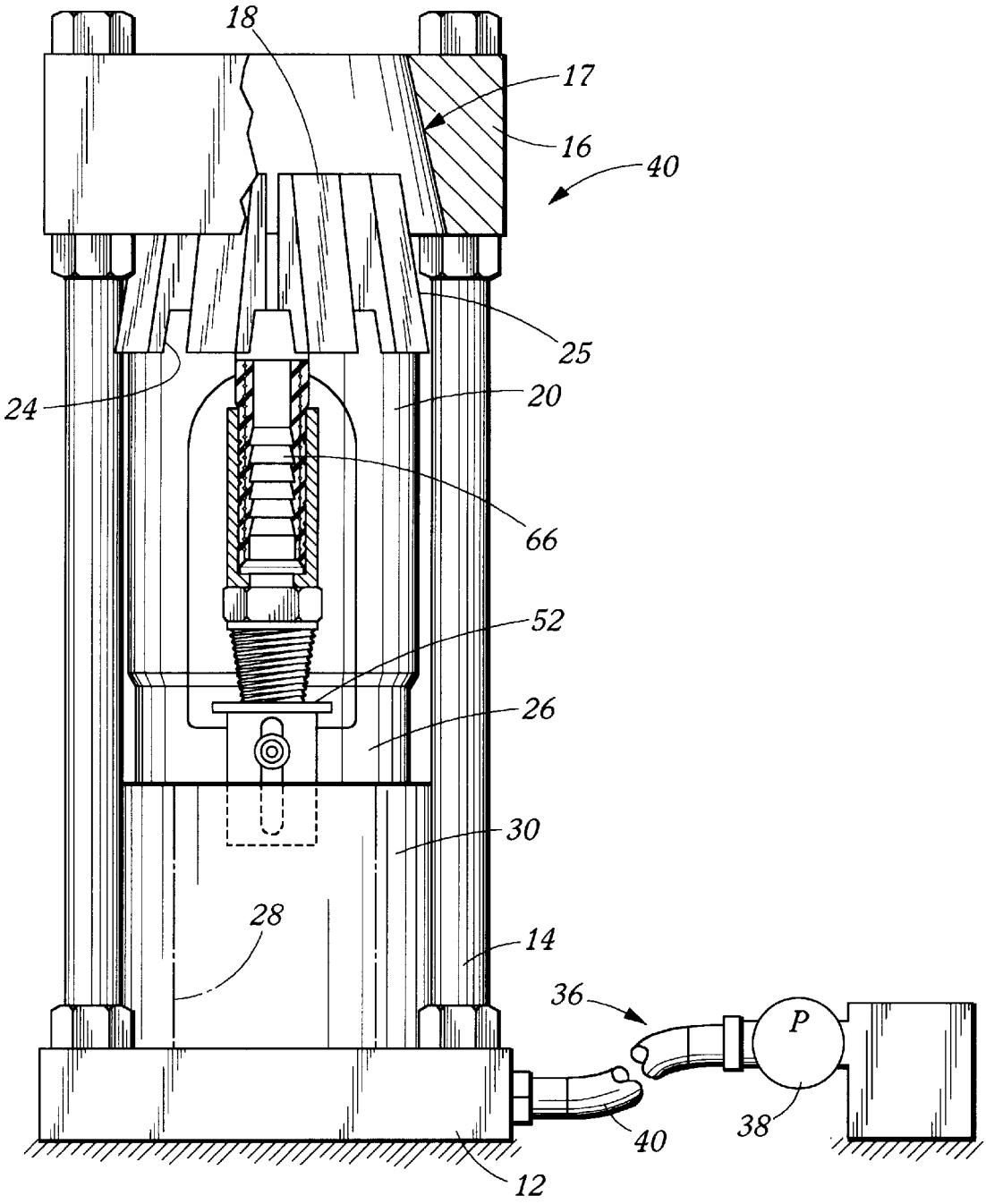
FIG. 7 is a perspective view of a crimping apparatus embodying the invention.

The full perspective view of the crimping apparatus, generally indicated at 40, with a hose coupling ready to be crimped is seen in FIG. 7. The crimping apparatus 40 is interconnected through four corner tie rods 14 to a fixed cam 17. This cam 17 engages the oppositely facing camming surface 25 of the die finger 18, as seen in FIG. 5. A plurality of die fingers 18 that make up the crimping die can be seen in FIG. 7, and are slidably mounted within corresponding tracks 24 of die cone 20 for radial inward movement towards longitudinal axis 22 of the crimping apparatus 40.

Die cone 20 is of generally cylindrical shape and includes a base portion 26 which is coupled to a piston shown in phantom at 28. The piston forms a part of an hydraulic ram 30 integral with cylinder base 12. The ram 30 and piston 28 are actuatable to move the die cone 20 and crimping die axially upwardly to the position shown in FIG. 8 by a conventional hydraulic system, generally indicated at 36, including pump 38, hydraulic lines 40, and hydraulic fluid. The die cone is retractable with springs or the like (not shown) from the crimping position of FIG. 8 to the loading, rest position of FIG. 7.

Figure 8:
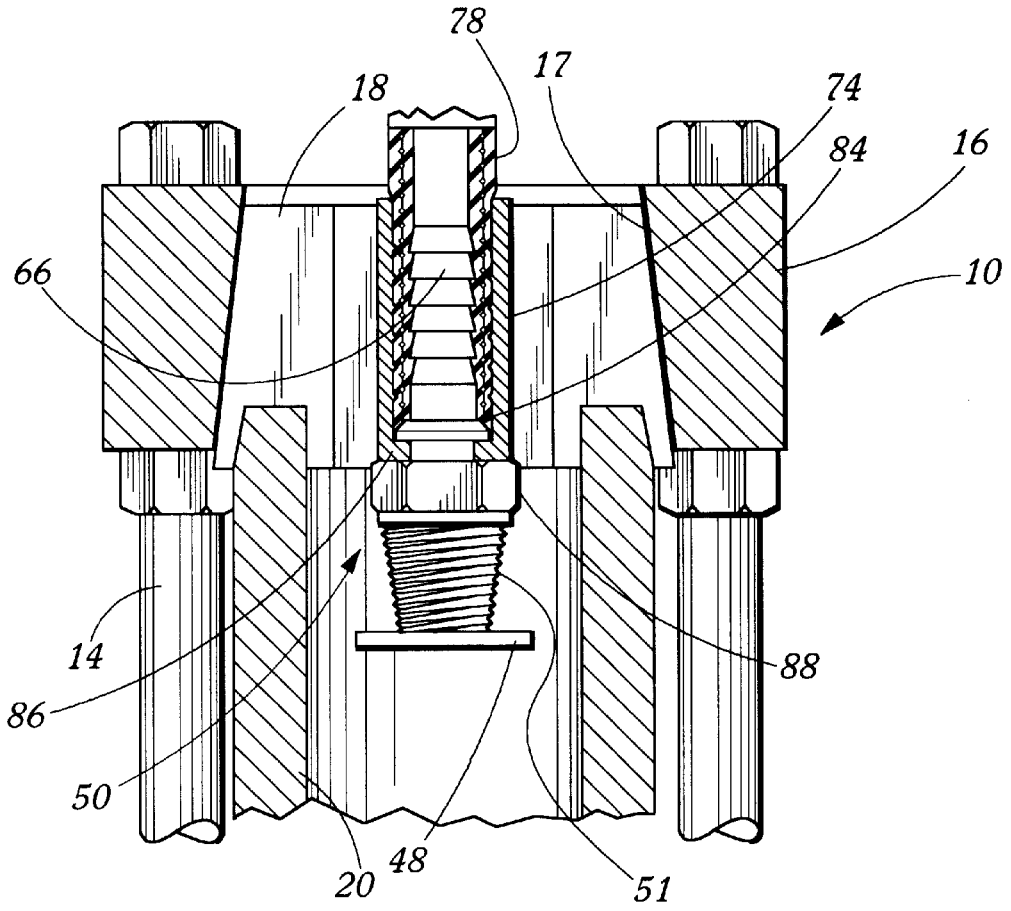
FIG. 8 is a sectional view of the crimping apparatus of FIG. 8, showing a ferrule being crimped.

In the rest position of FIG. 7, a stem 66 of a hose coupling sits upon a platform 52. To move from the loading, rest position of FIG. 7 to the operational position of FIG. 8, the pump 38 is turned on and ram 30 is actuated, so that piston 28 moves upwardly against base 26 of the die cone 20, causing it to displace axially upwardly. As the oppositely facing camming surface 25 of the die fingers 18 impinge upon the cam 17, the die fingers 18 are displaced radially inwardly along tracks 24 and against the fitting as shown in FIG. 8. The stroke of the piston is set in a control box (not shown) so that the radial extent of crimping is preselected. Different size die fingers are employed for different categorical sizes of hose and fittings.

The crimping apparatus shown in operation can be seen in FIG. 8. In operation, a hose fitting 50 generally indicated at 50, is assembled onto the end of hose 78. In the case of the two-piece fitting shown, ferrule 74 is first inserted over the end of the hose 78, and then the threaded male stem 66 is fully inserted with the hose end 78 abutting against stem shoulder 84, and shoulder portion 86 of the ferrule 74 abuts against hex 88 of a fitting 51.

Figure 9:
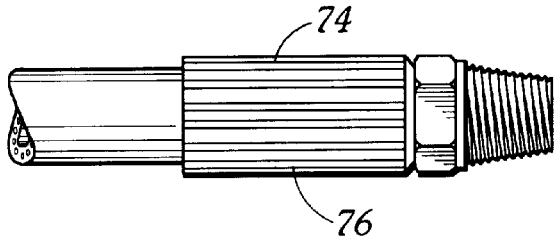
FIG. 9 is a view of the coupled hose assembly after the ferrule has been crimped.

The resulting crimped ferrule 74 is shown in FIG. 9. Crimping with the crimping die of the present invention, having sixteen locations for the metal to flow during the crimping process, results in crimped ferrule 74 having sixteen ribs 76 spaced circumferentially around the ferrule 74. As mentioned above, prior art ferrules crimped with eight die fingers may have a tendency to be uneven or bulge due to insufficient pressure about the ferrule during the crimping process. As a result, the extra metal flow between the die fingers may form uneven and sharp ribs on the crimped ferrule. With the die finger of the present invention, the slot 21 in the inner forming surface 19 provides an additional place for metal from the ferrule to flow during the crimping process. This additional place for metal to flow results in a more even crimp about the ferrule 74.

The sixteen locations, instead of the prior art eight locations, for the metal to flow during the crimping process also results in a more rounded ferrule inside diameter (ID). After crimping with an eight finger die, the inside diameter (ID) of the crimped ferrule resembles an octagon. The apexes of the octagonal shape form potential leak paths in the hose coupling. Adding a slot 21 to each die finger 18 changes the inside diameter (ID) of the ferrule from an octagonal shape to a more rounded shape. The more rounded shape helps create less of a potential leak path problem because there are no longer octagonal apexes in the inside diameter (ID) of the ferrule.

The foregoing description and illustrative embodiments of the present invention have been shown in the drawings and described in detail in varying modifications and alternate embodiments. It should be understood, however, that the foregoing description of the invention is exemplary only, and that the scope of the invention is to be limited only to the claims as interpreted in view of prior art. Moreover, the invention illustratively disclosed herein suitably may be practiced in the absence of any element which is not specifically disclosed herein.

What is claimed is:

1. A die finger for use in a crimping apparatus having a cone in which a plurality of die fingers are arranged radially about a longitudinal axis, said die finger having an inner forming surface and an oppositely facing camming surface sized for engaging a conical shaped cam of the crimping apparatus, wherein the improvement comprises:

said inner forming surface includes a slot oriented along the longitudinal axis.

2. The die finger of claim 1, wherein said slot includes a length, width and depth, the length being measured in the direction of the longitudinal axis.

3. The die finger of claim 2, wherein said slot includes a length substantially equal to the length of the inner forming surface.

4. The die finger of claim 3, wherein said slot is substantially cylindrical.

5. The die finger of claim 4, wherein said slot includes a width from about 5% to about 50% of the inner forming surface.

6. The die finger of claim 4, wherein said slot includes a depth of sufficient size to accommodate displaced metal from a crimped ferrule.

7. A crimping die for use in a hose fitting crimping apparatus that includes a cone in which said crimping die is arranged radially about a longitudinal axis, said crimping die comprising a plurality of circumferentially spaced, adjacent die fingers, each of said die fingers having an inner forming surface and an oppositely facing camming surface for engaging a conical shaped cam of the crimping apparatus, wherein the improvement comprises:

at least one die finger having an inner forming surface including a slot oriented along the longitudinal axis.

8. The crimping die of claim 7, wherein said slot includes a length substantially equal to the length of the inner forming surface.

9. The crimping die of claim 8, wherein all of said slot is substantially cylindrical.

10. The crimping die of claim 9, wherein said slot includes a width from about 5% to about 50% of the inner forming surface.

11. The crimping die of claim 10, wherein said slot includes a depth of sufficient size to accommodate displaced metal from a crimped ferrule.

12. The crimping die of claim 11, where said die fingers are equally spaced about the longitudinal axis.

13. The crimping die of claim 12, wherein all of said die fingers have an inner forming surface including a slot.

14. In an apparatus for crimping a fitting onto a hose end, said apparatus having (a) a crimping die comprising a plurality of circumferentially spaced, adjacent die fingers that are equally spaced, each of said die fingers includes an inner forming surface and an oppositely facing camming surface sized for engaging a conical shaped cam of the crimping apparatus against which said crimping die impinges;

(b) a platform adjacent the crimping die for receiving a ferrule and positioning a crimpable portion thereof between said die fingers;

(c) a means for moving said crimping die relative to the camming surface to cause the crimping die to be displaced radially inwardly against the ferrule and crimp the same onto the hose end;

wherein the improvement comprises:

at least one die finger having an inner forming surface including a slot oriented along the longitudinal axis.

15. The apparatus of claim 14 in which the crimping die comprises eight die fingers.

16. The apparatus of claim 14 in which the slot extends substantially along the full longitudinal length of the inner forming surface.

17. A method of crimping a ferrule onto a hose comprising the steps of:

(a) placing a ferrule circumferentially about a hose end within a crimp zone of a crimping apparatus, said crimping apparatus having a crimping die comprising a plurality of circumferentially spaced, adjacent die fingers that are equally spaced and arranged radially about a longitudinal axis of the crimping apparatus, each of said die fingers includes an inner forming surface and an oppositely facing camming surface for engaging a cam of the crimping apparatus, wherein each of said die fingers has an inner forming surface including a slot oriented along the longitudinal axis;

(b) applying a force to cause said plurality of die fingers to move;

(c) moving the die fingers radially inwardly against the ferrule; and (d) displacing metal of the ferrule between adjacent die fingers and in the slot of each of said die fingers so as to permanently secure the ferrule about the hose end.

18. The method of claim 17 in which the crimping die comprises eight die fingers.

19. The method of claim 17 in which the slot extends substantially along the full longitudinal length of the inner forming surface.

* * * * *

UNITED STATES PATENT AND TRADEMARK OFFICE

CERTIFICATE OF CORRECTION

PATENT NO. : 6,178,802 B1
DATED : January 30, 2001
INVENTOR(S) : Andrew P. Reynolds It is certified that error appears in the above-identified patent and that said Letters Patent is hereby corrected as shown below:

Column 5,
Line 37, (first line of claim 1), before the word "crimping", insert -- hose fitting --

Signed and Sealed this

Twenty-seventh Day of November, 2001

*Attest:*

Nicholas P. Godici

NICHOLAS P. GODICI
*Acting Director of the United States Patent and Trademark Office*

*Attesting Officer*